US005225240A

United States Patent [19]

Reichelt et al.

[11] Patent Number: 5,225,240

[45] Date of Patent: Jul. 6, 1993

[54] METHOD OF PRINTING THE PATTERN CARRIER OF A DISPLAY

[75] Inventors: Michael Reichelt, Esslingen; Kurt-Manfred Tischer, Wendlingen, both of Fed. Rep. of Germany

[73] Assignee: Nokia (Deutschland) GmbH, Fed. Rep. of Germany

[21] Appl. No.: 847,834

[22] Filed: Mar. 9, 1992

Related U.S. Application Data

[63] Continuation of Ser. No. 613,139, Nov. 15, 1990, abandoned.

[30] Foreign Application Priority Data

Nov. 15, 1989 [DE] Fed. Rep. of Germany ..... 3937942

[51] Int. Cl.[5] ..... B05D 5/12

[52] U.S. Cl. ..... 427/68; 427/428; 427/256; 427/287; 101/163; 101/170; 101/487

[58] Field of Search ..... 427/256, 68, 287, 428; 101/163, 170, 487

[56] References Cited

U.S. PATENT DOCUMENTS

| | | | |
|---|---|---|---|
| 3,255,695 | 6/1966 | Johnson et al. | 101/211 |
| 3,619,446 | 11/1971 | Nauta | 264/102 |
| 4,043,013 | 8/1977 | Zeppernick et al. | 29/132 |
| 4,200,044 | 4/1980 | Vested | 101/401.1 X |
| 4,209,551 | 6/1980 | Masaki et al. | 427/287 X |
| 4,292,104 | 9/1981 | Heimbach et al. | 101/170 X |
| 4,479,432 | 10/1984 | Masaki et al. | 101/170 |
| 5,069,733 | 12/1991 | Nill et al. | 156/67 |

FOREIGN PATENT DOCUMENTS

| | | |
|---|---|---|
| 0106543 | 3/1984 | European Pat. Off. . |
| 1905198 | 8/1969 | Fed. Rep. of Germany . |
| 2227485 | 1/1973 | Fed. Rep. of Germany . |
| 2433749 | 1/1976 | Fed. Rep. of Germany . |
| 3709206 | 9/1988 | Fed. Rep. of Germany . |
| 1390833 | 4/1975 | United Kingdom . |

OTHER PUBLICATIONS

Patent Abstracts of Japan M-349, Jan. 9, 1985, vol. 9, No. 3, entitled: "Transfer Material for Transfer-type Printing".

Kunststoff-Berater, 9, 17, Jg 1972 (p. 730).

*Primary Examiner*—Michael Lusigan
*Assistant Examiner*—Diana Dudash
*Attorney, Agent, or Firm*—Ware, Fressola, Van Der Sluys & Adolphson

[57] ABSTRACT

The covering (13) of a printing roller (10) for transferring hot glue printing material from a printing block to the front panel of a display consists of cast silicone rubber without any silicone fluid. The use of silicone-fluid-free silicone rubber ensures that the printing materials will adhere well to the panel even in a sequence of printings, because the adhesion properties of the panel will not have been reduced by silicone fluid that would otherwise have been transferred from the roller to the panel. Although the roller covering is devoid of silicone fluid as stripping agent, the printing material nevertheless separates readily from the covering, because the latter is cast and therefore has a very smooth surface.

5 Claims, 1 Drawing Sheet

METHOD OF PRINTING THE PATTERN CARRIER OF A DISPLAY

This is a continuation of copending application Ser. No. 07/613,139 filed on Nov. 15, 1990, now abandoned.

DESCRIPTION

1. Technical Field

The present invention relates to a method of printing -inter aliaphosphor and black matrix strips on a plane or cylindrical printing pattern carrier, especially the front panel of a display. When phosphor or black matrix particles have to be printed on a pattern carrier, they are mixed with a binder developing adhesive properties on being heated ("hot glue") and this mixture is then distributed on a printing block, whence it is taken off by a printing roller and transferred to the pattern carrier. Over and above the method just described, the invention also relates to a printing roller for such a method.

2. State of the Art

A method of transferring hot glue printing material from a printing block to the front panel of a display described in DE 37 09 206 Al. A plane printing block is used with a pattern of cavities that corresponds to the pattern of the structure to be printed. The cavities are filled with the printing ink, i.e. a mixture of a hot-setting binder (glue) and the particular particles to be printed. The transfer from the plane printing block to the plane front panel is obtained by means of tampon printing with a cylindrical tampon, i.e. with a printing roller with a relatively soft covering made of silicone rubber. In tampon printing the hardness of the silicone rubber tampon will typically range from about 40 to 80 Shore A. The printing pattern on the block is so distorted with respect to the pattern really desired for the front panel that distortions caused by temperature differences between the block and the front panel during transfer, as also by distortions of the printing roller, will be compensated and the desired pattern will effectively be produced on the front panel. When printing a front panel for a colour display, strips or point structures are printed successively with three different phosphors, each of which will phosphoresce in a different colour upon excitation by electron beams. Often this is supplemented by the printing of black matrix strips or areas, this being usually done in such a way that two neighbouring phosphor strips are separated by a black matrix strip. When such a pattern is to be produced, the front panel—for example—will be moved on a belt past four printing blocks, all of which are arranged at substantially the same height as the panel. Using printing rollers that move to and fro, one at each printing block, the pattern is then transferred as the panel comes to a halt at each block.

Printing patterns made up of printing ink or black matrix or other materials (e.g. bonding agent patterns, photoresist patterns) are produced not only on the front panels of displays with electron beam excitation, but also—inter alia—on the front and rear substrates of liquid crystal displays or electroluminescence displays. The printing pattern carriers may be plane or cylindrical, and may be plates or foils.

It has been found that the printing ink to be transferred will adhere less and less well to the pattern carrier as the number of previous printings increases. On the occasion of the first printing the ink will therefore adhere considerably better than is the case for the last printing. Accordingly, there existed the problem of finding a method and a device for the purpose here considered that would make it possible to transfer all the printing inks reliably to the printing pattern carrier of a display.

DESCRIPTION OF THE INVENTION

According to the invention, a printing roller with a covering made of silicone rubber devoid of silicone fluid is used to transfer hot glue printing material from a printing block to the pattern carrier of a display. Advantageously, moreover, the covering will be cast from the said material.

Basically, tampon printing processes have hitherto used tampons made of silicone rubber containing silicone fluid. The silicone fluid serves as a separating or stripping agent and ensures that the ink taken up by the tampon can be readily transferred to the medium that is to be printed. Notwithstanding the stripping agent, the tampon will accept ink when this is made available by the printing block in sufficiently great quantities. It has been found that during the printing of the carrier tiny quantities of silicone fluid find their way onto areas that have not yet been printed. The printing ink will subsequently adhere very badly to such areas that have been wetted by silicone fluid.

Since the covering of the printing roller according to the invention consists of silicone rubber devoid of silicone fluid, the effect just discussed will not occur during printing. A carrier surface with identical adhesion characteristics is therefore available for all the successive printings.

It is quite obvious that the absence of silicone fluid from the silicone rubber covering of the roller does not only lead indirectly to improved adhesion of the inks applied to a carrier in sequence printings, but that there is also a direct improvement of the adhesion of the ink on the roller covering. Given a badly chosen hot-setting binder (glue) and badly chosen processing conditions, this effect may once again lead to a situation where the printing ink, just as in the known method, is badly transferred from the roller to the carrier, but this time not because the adhesion properties of the carrier have worsened, but because adhesion to the roller has been improved. It is therefore of advantage to use a glue characterized by particularly good adhesion to the carrier material. It is also of advantage to maintain the printing block at a clearly higher temperature than the roller, and the roller at a higher temperature than the front panel. The former temperature difference should preferably be of the order of several tens of degrees, but the latter may be kept at Just a few degrees.

Very special advantages are however associated with a printing roller whose silicone-fluid-free silicone rubber covering has been cast. Such a printing roller has a very smooth surface that takes up sufficient printing ink from the block and then transfers it very readily to a printing pattern carrier.

Silicone rubber, even when devoid of silicone fluid, can be produced within a broad band of different hardnesses. It has been found that accurate structure printing is facilitated if the roller covering is made softer as the structure to be printed becomes finer. When printing very fine matrix strips, best results were obtained with a rubber hardness of about 40–50 Shore A. Given coarser structures, the hardness of the roller covering may be increased to about 80 Shore A.

Structural accuracy is also enhanced when the printing roller is supported on very readily revolving bearings. i.e. when it is not driven. Best results were obtained with a non-driven printing roller with a cast covering made of silicone rubber devoid of silicone fluid and having a hardness of about 40–45 Shore A.

WAYS OF CARRYING OUT THE INVENTION

Figure 1:
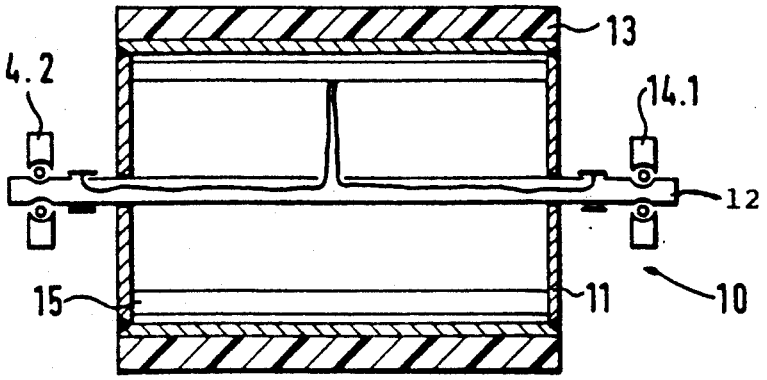
FIG. 1 shows a longitudinal section through a printing roller with a covering consisting silicone rubber not containing any silicone fluid

The printing roller 10 shown in FIG. 1 consists of a hollow metal cylinder 11 with a bearing shaft 12 and a roller covering 13. The bearing shaft 12 is supported on two bearings 14.1 and 14.2 that permit it to revolve very readily. Acting on the bearings is a device (not shown on the drawing) for moving the printing roller 10 to and fro. The surface of the roller can be heated to an adjustable temperature by means of the electric heating device 15.

The hollow cylinder 11 has a roughened surface to ensure good adhesion of the roller covering 13. The roller covering is cast from silicone rubber devoid of silicone fluid. A roller with such a covering was produced in accordance with the inventors' instructions by Messrs. Tampo Print GmbH of Alertshausen, Federal Republic of Germany, and may be obtained from them.

The printing roller described above by reference to FIG. 1 was used in a method that will now be described by reference to FIG. 2.

Figure 2:
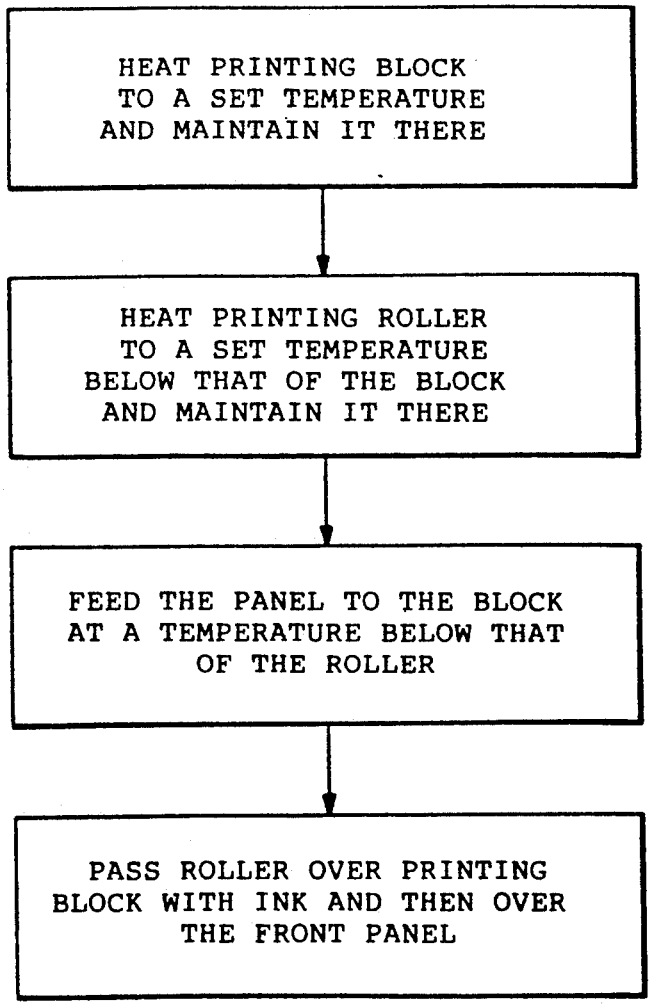
FIG. 2 shows the flow chart of a method of transferring the hot glue printing material from a printing block to the front panel of a display.

According to the sequence shown in FIG. 2, a printing block with the hot glue is first heated to a given temperature and then maintained at this temperature. A material supplied under the designation 64/2511 by the Blythe company, Netherlands, was used as hot glue. Customary black matrix and phosphor particles were added to this hot glue in such quantities as to make them account for about 80% by weight of the total. The hot glue printing materials formed in this manner are fluid at a printing block temperature of about 60° C.

The printing roller 10 was heated to about 30° C., that is to say, to a temperature a few degrees below that of the printing block. This roller temperature, just like the block temperature, was maintained constant to within a few degrees. The front panels in use were fed to the printing device at environmental temperature, i.e. at about 20° C., and were therefore a few degrees cooler than the printing roller.

Maintaining the aforesaid temperature conditions, the printing roller was passed first over the particular printing block and then over the front panel situated at the same height. The angle of rotation of the printing roller was always set to a given value before it was placed either on the printing block or the front panel, thereby making possible accurate location of the printing.

Using a roller covering of the described type with a hardness of 40 Shore A, it was found that matrix strips having a width of 40 mm could be printed with an accuracy of a few mm.

We claim:

1. A method of transferring a phosphor hot glue printing material from a printing block to a display panel to produce a luminous display, said method comprising the steps of:

providing a display panel;

maintaining the display panel at a temperature;

selecting a phosphor hot glue print material, which exhibits good adhesion characteristics to the display panel;

providing a printing roller having a cover formed of silicone fluid-free silicone rubber;

maintaining the printing roller at a temperature higher than the temperature of the display panel;

providing a printing block with the phosphor hot glue print material thereon;

maintaining the printing block and the phosphor hot glue print material at a temperature higher than the temperature of the printing roller;

rolling the printing roller over the printing block so that the phosphor hot glue printing material is picked up by the cover of the printing roller; and rolling the printing roller over the display panel so that the phosphor hot glue printing material is transferred from the silicone fluid-free silicone rubber of the cover to the display panel in order to produce a luminous display.

2. A method as described in claim 1, wherein the display is successively printed with the two additional phosphor hot glue printing materials and a black matrix hot glue material.

3. A method as described in claim 1, wherein the silicone fluid-free silicone rubber has a rubber hardness in a range of 40–50 Shore A.

4. A method as described in claim 1, wherein the phosphor hot glue printing material is about 80% by weight of phosphor material and about 20% by weight of hot glue.

5. A method as described in claim 1, wherein the step of maintaining the temperature of the printing block higher than the temperature of the printing roller comprises the step of maintaining the printing block at a temperature in the order of several tens of degrees centigrade higher than the temperature of the printing roller; and the step of maintaining the printing roller at a temperature higher than the temperature of the display panel comprises the step of maintaining the temperature of the printing roller few degrees centigrade higher than the temperature of the display panel.

* * * * *